US005517573A

United States Patent [19]

Polk et al.

[11] Patent Number: 5,517,573

[45] Date of Patent: May 14, 1996

[54] PORTED LOUDSPEAKER SYSTEM AND METHOD WITH REDUCED AIR TURBULENCE

[75] Inventors: Matthew S. Polk; Colin B. Campbell, both of Baltimore, Md.

[73] Assignee: Polk Investment Corporation, Wilmington, Del.

[21] Appl. No.: 294,412

[22] Filed: Aug. 23, 1994

Related U.S. Application Data

[63] Continuation-in-part of Ser. No. 453,557, May 24, 1995, which is a continuation of Ser. No. 177,080, Jan. 4, 1994, abandoned.

[51] Int. Cl.[6] ..... H04R 25/00

[52] U.S. Cl. ..... 381/159; 381/160; 381/154; 181/156; 181/160

[58] Field of Search ..... 381/159, 160, 381/158, 154, 188, 205; 181/155, 156, 160, 199

[56] References Cited

U.S. PATENT DOCUMENTS 4,987,601 1/1991 Goto ..... 381/159

*Primary Examiner*—Curtis Kuntz
*Assistant Examiner*—Sinh Tran
*Attorney, Agent, or Firm*—Snell & Wilmer

[57] ABSTRACT

A vented loudspeaker system is provided which has at least one active driver and a port opening in a speaker cabinet, Disks or baffle plates are mounted a predetermined distance to and concentric to the port opening, resulting in a vented system achieving an equivalent performance as would result from a flared, ducted port, but with several performance advantages and simpler construction. Flow guides are provided, attached to the disks or baffle plates, extending back into the port to block areas of stagnant air and enhance laminar air flow.

11 Claims, 4 Drawing Sheets

PORTED LOUDSPEAKER SYSTEM AND METHOD WITH REDUCED AIR TURBULENCE

CROSS REFERENCES TO RELATED APPLICATIONS

This application is a continuation-in-part of co-pending patent application Ser. No. 08/453,557, which is a continuation of patent application Ser. No. 08/177,080, and entitled Ported Loudspeaker System and Method.

FIELD OF THE INVENTION

This invention relates generally to loudspeaker systems, and in particular relates to an improved loudspeaker having a unique port or vent geometry together with a corresponding method of porting the loudspeaker in an efficient manner.

Vented box loudspeaker systems have been popular for at least 50 years as a means of obtaining greater low frequency efficiency from a given cabinet volume. Great advances were made in understanding and analyzing vented loudspeaker systems through the work of Thiele and Small during the 1970s. While the proliferation of personal computers has enhanced the ability to optimize vented loudspeaker system designs, practical considerations often impede or prevent actual construction of optimized loudspeaker system designs.

There are two basic approaches in common use in connection with vented loudspeaker systems, these being the ducted port and the passive radiator. The advantages of the ducted port approach include the fact that it is inexpensive to implement and requires very little space on the loudspeaker cabinet baffle. Additionally, there are no mechanical limits on air volume velocity and there are low mechanical losses. Finally, there are no moving parts involved in a ducted port approach and the arrangement is not sensitive to physical orientation.

There are, however, disadvantages to the ducted port approach. If the diameter of the port is too small, non-linear behavior such as chuffing or port-noise due to air turbulence can result. Organ pipe resonances proportional to the length of the port can also be a problem, as can transmission of undesirable mid-range frequencies from inside of the loudspeaker cabinet. In addition, the acoustic mass of air required to achieve certain desirable low frequency tunings suggests the use of a large diameter duct which is impractically long in order to keep port-noise and turbulence to an acceptable minimum. The compromise use of the smaller diameter duct results in a shorter length, but often produces annoying amounts of port-noise and may become highly inefficient due to turbulence.

In the case of using passive radiators in a vented loudspeaker system, the advantages include the fact that lower frequency tunings are easily achieved, and there are no organ pipe resonance problems. Moreover, mid-range transmissions from inside of the loudspeaker cabinet are substantially eliminated, greater efficiency is achieved due to larger radiating surfaces, and chuffing or port-noise is essentially absent.

There are, however, disadvantages to use of a passive radiator approach. These include the higher cost to implement such an approach, as well as the inherent mechanical limits on air volume velocity. Moreover, passive radiators are sensitive to physical orientation and require more space on the loudspeaker baffle than the ducted port approach.

Finally, passive radiator systems involve greater mechanical losses than a ducted port and the suspension of the passive radiator reduces system total compliance and limits linearity.

As discussed in co-pending patent application Ser. No. 08/453,557, audible noise due to turbulent flow in ported loudspeakers is a common problem. This problem is exacerbated by the high volume velocities of air required for high sound pressure levels at low frequencies. In addition, in certain applications, such as bandpass woofers, the absence of higher frequencies makes the presence of turbulence induced noise much more objectionable.

In the co-pending application referenced above, an invention is disclosed and claimed which overcomes many of the difficulties associated with standard ducted ports and achieves many of the advantages of passive radiators, but without the disadvantages. Briefly, the invention in that application provides a technique to achieve the same operation as would be provided by a flared ducted port, but with several performance advantages and a much simpler, lower cost of implementation. This is achieved through provision of a port in the speaker baffle, with the necessary additional acoustic mass to achieve a desired tuning frequency being provided by one or more disks or baffle plates of a predetermined size being provided more or less concentric to and adjacent to the port but spaced therefrom by a predetermined distance. This creates a duct which is in essence a flared cross-section at either end and which offers no straight-line path from the air volume inside the cabinet to the air outside the cabinet.

In experiments which have been performed subsequent to filing of the prior application referenced above, efforts have been made to further reduce the size and increase the performance of the arrangement there disclosed. Experiments have revealed that a geometry such as disclosed in the prior application particularly with high volume velocities, while advantageous, still has some turbulence in the area between the opening of the through hole end of the flat plate, which leads to both loss and audible noise.

OBJECTS AND SUMMARY OF THE INVENTION

It is an object of this invention to provide an improved arrangement and method for use in a vented port loudspeaker system for simulating a flared, ducted port with a unique geometry for reducing air turbulence.

It is another object of this invention to provide a port or vent structure which allows for greater volume of air flow through the port structure without turbulence and with greatly reduced noise.

Briefly, and in accordance with one embodiment of the invention, a port is provided in the speaker baffle of the loudspeaker system, and additional acoustic mass to achieve a desired tuning frequency is provided by one or more disks or baffle plates of a predetermined size and configuration being provided more or less perpendicular to and adjacent the port but spaced therefrom by a predetermined distance. This creates a duct which is in essence a flared cross-section at either end, and which offers no straight line paths from the air volume inside the cabinet to the air outside the cabinet. Further, one or more flow guides substantially concentric to the port and attached to the disks or baffle plates and extending from the disks or baffle plates back into the port and having concave or slanted sides is used to block areas of stagnant air and enhance laminar air flow through the port/disc or baffle configuration.

Other objects and advantages of the present invention will appear from the following detailed description taken in conjunction with the accompanying drawings.

DETAILED DESCRIPTION

Figure 1:
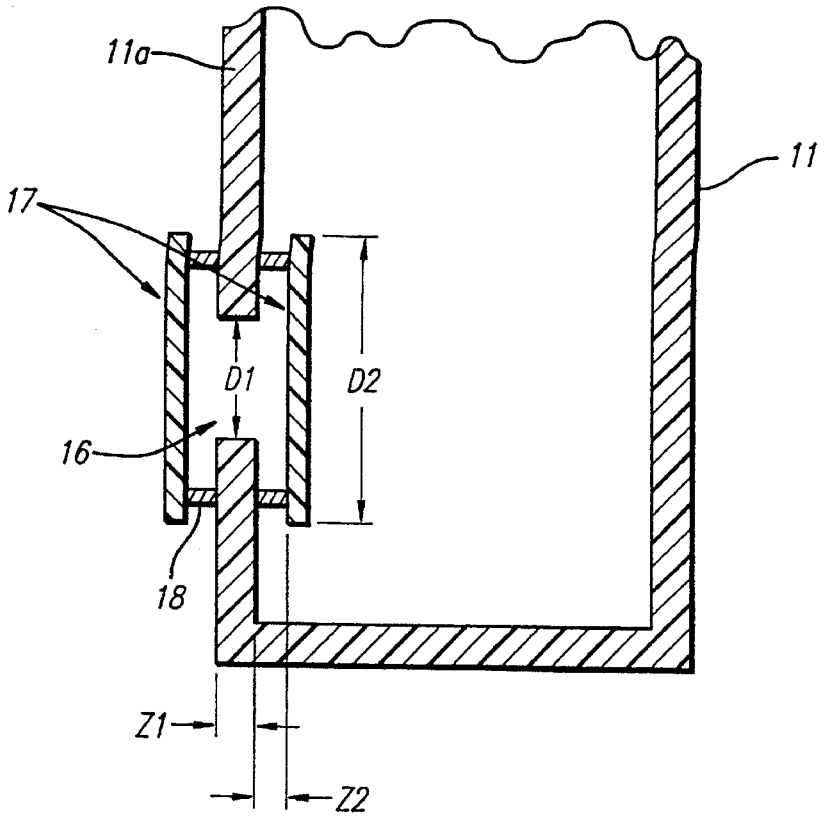
FIG. 1 is a partial cross-sectional view of a speaker enclosure having a port and having discs or baffles as discussed in the co-pending application referred to above.

FIG. 1 is a partial cross-sectional view of a loudspeaker enclosure incorporating the invention disclosed in the co-pending application referred to above. In FIG. 1, a loudspeaker system includes a cabinet 11 having a front baffle 11*a* which suitably mounts one or more active drivers (not shown). A port 16 is configured by cutting a hole in the front baffle, with the port 16 having a diameter D1 and a depth or length Z1. The necessary acoustic mass to achieve the same tuning frequency as in a conventional port ducted system is achieved by providing disks or plates 17 of a specified size or diameter D2 disposed more or less perpendicular to port 16 on either side of the baffle 11*a* and spaced a predetermined distance Z2 from the baffle. The distance Z2 between each of the disks and the baffle is chosen such that the area of the cylindrical surface between each disk 17 and the baffle or cabinet wall formed by the extension of the port opening 16, is approximately equal to the area of the port itself. The diameter of disks 17 can be somewhat arbitrarily chosen based on the available baffle area. It is only required that the area of the cylindrical surface formed by the outer part of the space between the baffle and each disk 17 be significantly larger than the area of the port. Struts 18 or a similar mounting arrangement are provided for suitably mounting the disks or baffles 17. The struts 18 should be small enough so as not to interfere significantly with the airflow. Thereby, a relatively smooth transition is made from the area of port opening 16 to the large area at the edge of the disk 17 outside and inside the cabinet. Basically, what results with the configuration of FIG. 1 is an acoustic mass of air defined by a duct having a cross-sectional area which varies according to a continuous (or piece-wise continuous) function from inside to outside the cabinet and which increases monotonically from a minimum value along its mid-section to a larger cross-section at either end. The acoustic mass of air is tuned to a single frequency and moves substantially as a unitary mass in the process of radiating sound. The construction shown in FIG. 1 is essentially a flared cross-section at either end and constitutes an arrangement which does not have any straight-line path from the air volume inside the cabinet to the air outside the cabinet.

It has been found, however, in connection with the arrangement shown in FIG. 1 that areas of stagnant air result in air turbulence occurring between the flat disks or baffle plates 17 and the speaker baffle 11*a* at the opening of the port through-hole 16. This turbulence has been found to cause audible noise at high volume velocities, particularly for low frequencies.

Figure 2:
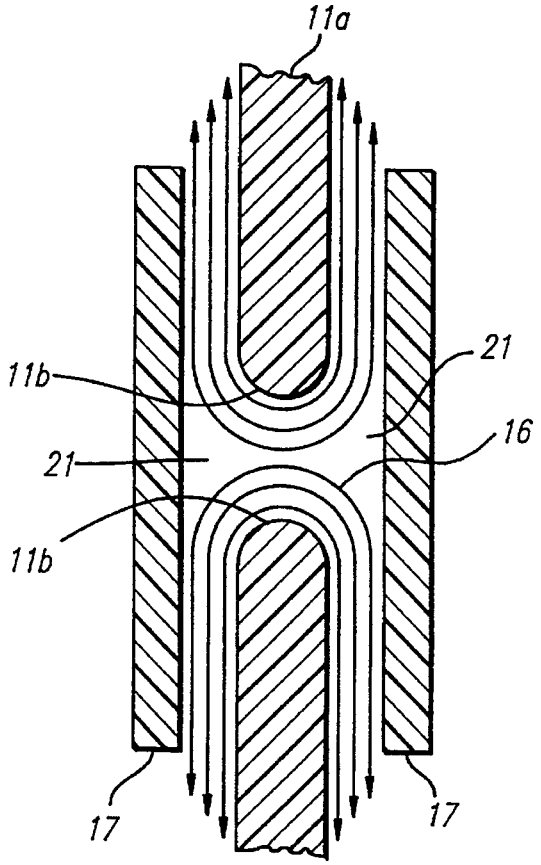
FIG. 2 is a schematic cross-section of a port area of FIG. 1 illustrating areas of turbulent or non-laminar air flow.

Referring now particularly to FIG. 2, there is shown a partial cross-sectional view of the port and disk or baffle plate portion of the loudspeaker enclosure, and wherein the struts 18 or other means for mounting the disks or baffle plates 17 have been omitted for sake of clarity. The arrowed lines extending between the baffle 11*a* and the disks 17 and extending through the port 16 are intended to show air flow between the interior of the loudspeaker enclosure and the air volume exterior thereto through the port 16.

As shown in FIG. 2, rounding off the edges of the baffle 11*a*, shown generally in FIG. 2 by reference numeral 11*b*, offers an improvement which enhances laminar flow through the port opening. However, there still remain pockets of stagnant air or non-laminar flow, generally referred to by reference numeral 21 in FIG. 2. Experiments have shown that with a construction such as shown in FIG. 2, that while air flows smoothly along the paths traced in FIG. 2, the areas 21 of non-laminar flow are essentially stagnant. Moreover, as the velocity of air through the port structure increases, these areas are increasingly mixed with the flow in a turbulent manner which produces audible noise.

Figure 3:
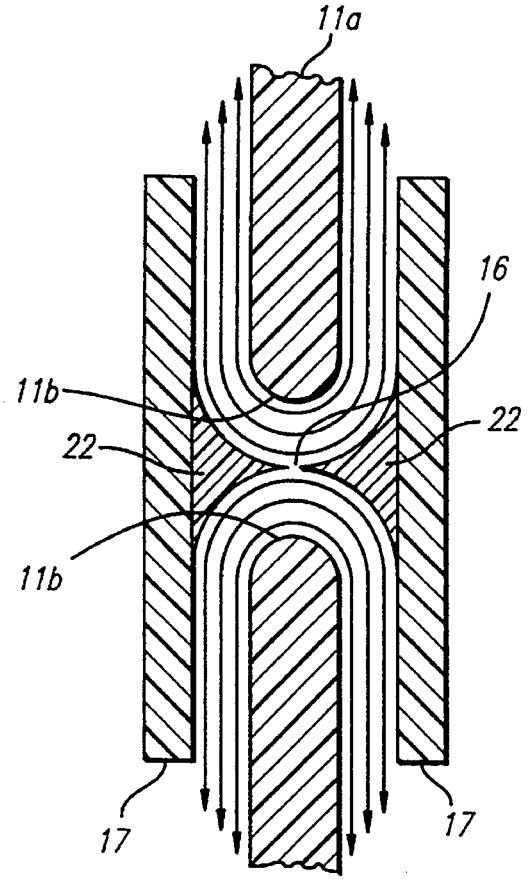
FIG. 3 is a cross-sectional view of a port and baffle or disk arrangement similar to FIG. 2, but showing the interposition of flow guides in accordance with the present invention.

Turning now to a consideration of FIG. 3, there is shown a partial cross-section of a port and disk structure similar to FIG. 2, but which incorporates flowguides in accordance with one aspect of the present invention. As shown in FIG. 3, flow guides 22 are provided affixed to the disks or baffle plates 17 and extending from the disks or baffle plates 17 back into the port opening 16 substantially concentric with the port. As illustrated in FIG. 3, the flow guides 22 are more or less in the shape of an inverted circular funnel with concave sides or they can have slanted sides. The purpose of the flow guides is to essentially fill or block the partly stagnant areas of non-laminar flow 21 (FIG. 2). The curvature of the sides of the flow guides is made to be concentric with the rounded edges 11*b* of the baffle 11*a* forming the edges of the port through hole 16. This creates a port structure whose cross-sectional area increases smoothly from a minimum in the center to a larger cross-section at either end and whose flow characteristics remain more or less constant with higher velocities of flow. As a result, the possibility of turbulence and noise arising from the mixing of partly stagnant air with the primary flow is greatly reduced.

Figure 4:
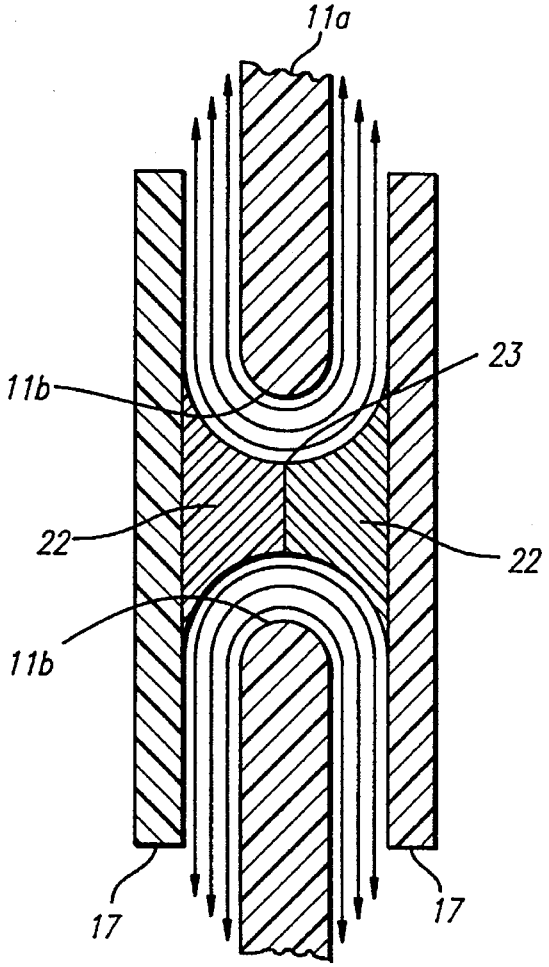
FIG. 4 is a cross-sectional view of a port area similar to FIG. 3, but showing flow guides interconnected through the port opening in accordance with one aspect of the present invention.

Referring to FIG. 4, there is shown a cross-sectional view of a port and disk or baffle plate structure similar to FIG. 3, but showing another aspect of the present invention in providing a connector for the flow guides. As shown in FIG. 4, the flow guides 22 are provided attached to disk or baffle plates 17 and extending into the port opening 16, but in the arrangement of FIG. 4 the two flow guides 22 are in fact connected by a connector portion 23 to provide in essence a continuous flow guide through the port 16. This arrangement essentially creates a cylindrical cross-section for air to flow through the port, which in fact serves two beneficial functions. First, it has been found that by channeling the flow of air through a donut-like cylindrical cross section, rather than a circular cross section, that turbulence is further reduced. Secondly, it has been found that the flow characteristics are more consistent over a wider range of flow velocities using the continuous flow guide arrangement as shown in FIG. 4 as compared to a flow guide arrangement such as shown in FIG. 3.

In accordance with a specific embodiment of the invention and as shown in FIG. 4, the thickness of baffle 11*a* is 1 inch, the distance between the baffle 11*a* and the inner edge of the disks 17 is 1 inch, the diameter of the port throughhole 16 is 3 inches, the rounded edges 11*b* of the baffle have a ⅜ inch radius, the diameter of disk 17 is 10 inches and its configuration is circular, the diameter of the connector 23 is one inch, and, as discussed previously, the radius of the flow guides 22 and connector portion 23 is concentric to the radius of the rounded edges 11*b* forming the port opening. A port structure constructed in accordance with the present invention and with the dimensions of the specific arrangement discussed in FIG. 4 has an acoustic mass of approximately 50 $kg/m^{-4}$.

Figure 5:
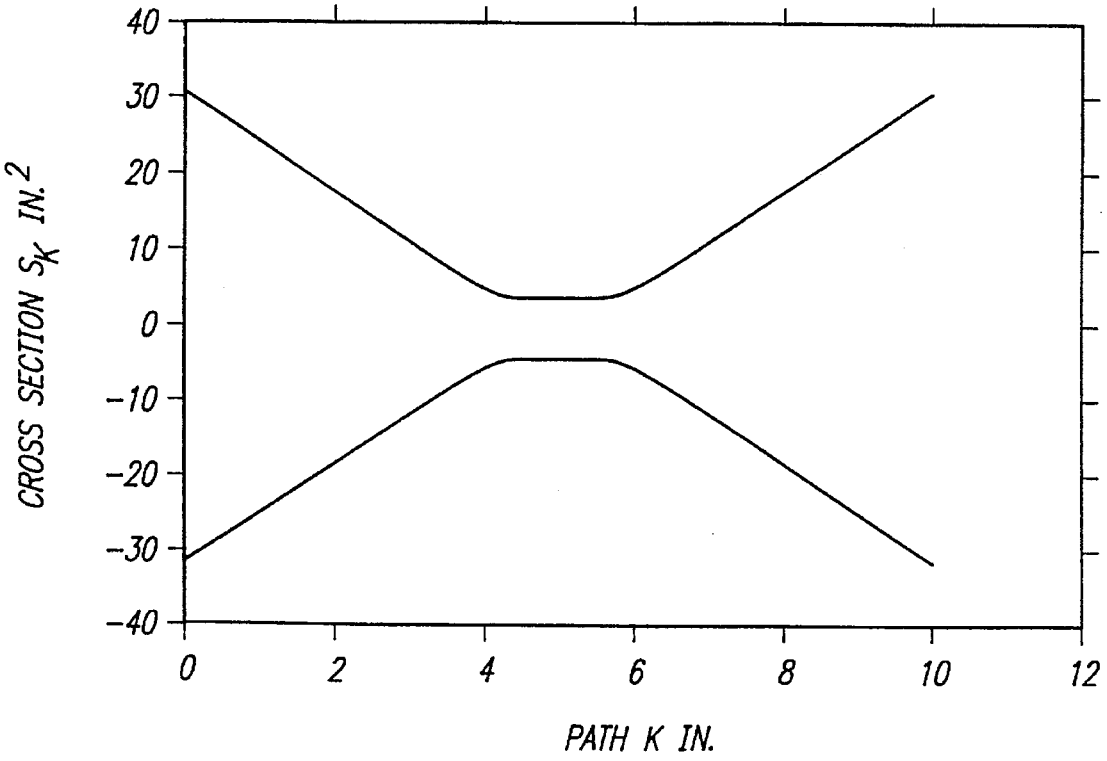
FIG. 5 is a graph of the cross-sectional area of the port structure versus distance travelled along the air flow path.

Referring now to FIG. 5, there is shown a graph of port cross sectional area $S_k$ in square inches versus path length k in inches along and through the port opening for the arrangement shown in FIG. 4. As shown in FIG. 5, the port structure of FIG. 4 provides the equivalent of a port 10 inches long having a cross section of over 33 square inches at the ends and a cross section of less than 7 square inches in the center. And, in accordance with the principles of this invention, this equivalent port structure is provided with a physical structure considerably smaller than the equivalent length and area as shown in FIG. 5.

Figure 6:
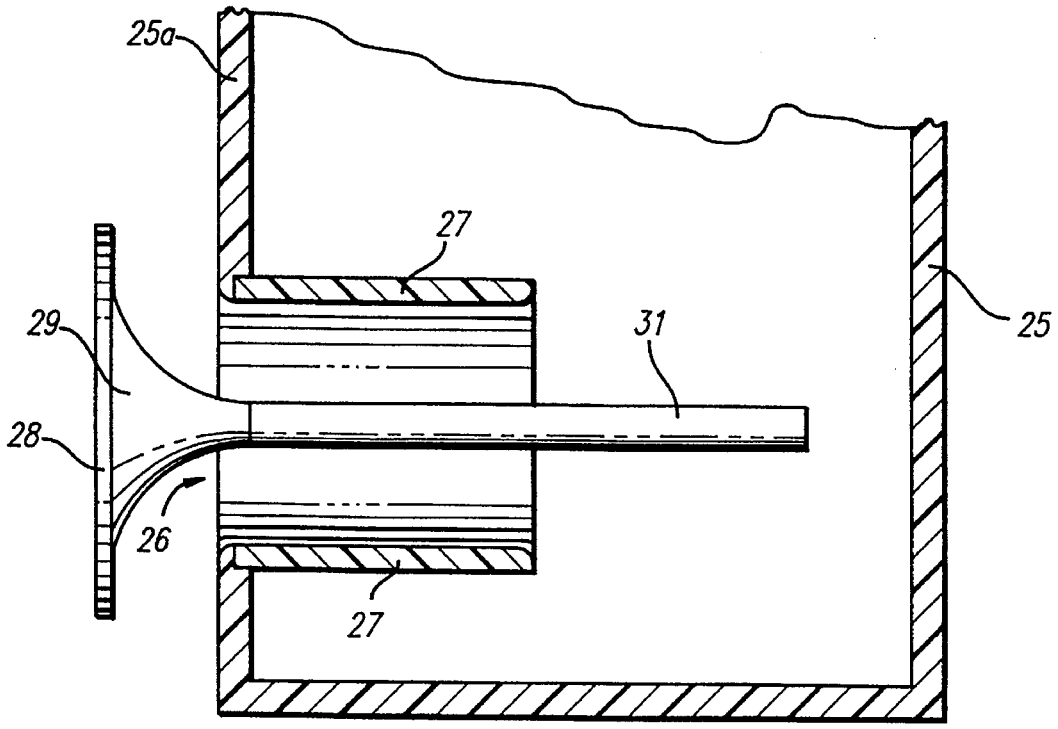
FIG. 6 is a cross-sectional view of a portion of a vented loudspeaker enclosure showing a flow guide and connector extension extending through the port or vent tube in accordance with one aspect of the present invention.

In accordance with one aspect of the present invention, it has been determined that it is not necessary to provide a flow guide or a disk or baffle plate at both ends of the port opening or vent tube. Specifically, it has been found Sufficient in many applications to provide a disk or baffle plate and/or a flow guide only at the outer end of the port structure since any noise generated by turbulence at the inside end of the port structure will be effectively contained by the cabinet or enclosure in the port structure itself. As an alternative, it has been found to be desirable in other applications to attach a connector to the flow guide on a disk or baffle plate throughout the entire length of a port or vent tube as an extension of the flow guide, even when no disk or flow guide is included on the inside end of the connector. FIG. 6 illustrates such an arrangement.

In FIG. 6 an enclosure or cabinet 25 has a speaker baffle 25*a* which mounts at least one driver (not shown). A port opening generally indicated by reference numeral 26 is formed by a hole or aperture in the baffle 25*a* and, as shown in FIG. 6, has a port or vent tube 27 extending from the port 26 back into the interior of the enclosure 25. In accordance with the principles of this invention a disk or baffle plate 28 is provided spaced from the baffle 25*a* by a predetermined distance and having a diameter greater than the diameter of the port opening 26. A flow guide 29 is provided and is attached to the disk or baffle plate 28 and extends back towards the interior of the enclosure. In the arrangement shown in FIG. 6, a connector portion 31 is attached to flow guide 29 and extends through the length of the port or vent tube 27 back into the interior of the enclosure 25.

As was explained above, it has been found in accordance with one aspect of the present invention that by channeling the flow of air through a donut-like cylindrical cross section rather than a circular cross section, turbulence is further reduced and flow characteristics are more consistent over a wider range of flow velocities. Many of the benefits of these findings are obtained in a structure such as shown in FIG. 6 without incurring the expense of having another disk and flow guide at the interior of the cabinet. This, of course, results in lower cost. In FIG. 6 struts or other mounting arrangements for the disk 28, flow director 29 and connector 31 are not shown, but may be conveniently provided. The only criteria is that the struts attaching the structure to the baffle 25*a* or other portion of the enclosure be sufficiently small so as not to significantly interfere with air flows through the port and disk or baffle plate structure.

Figure 7:
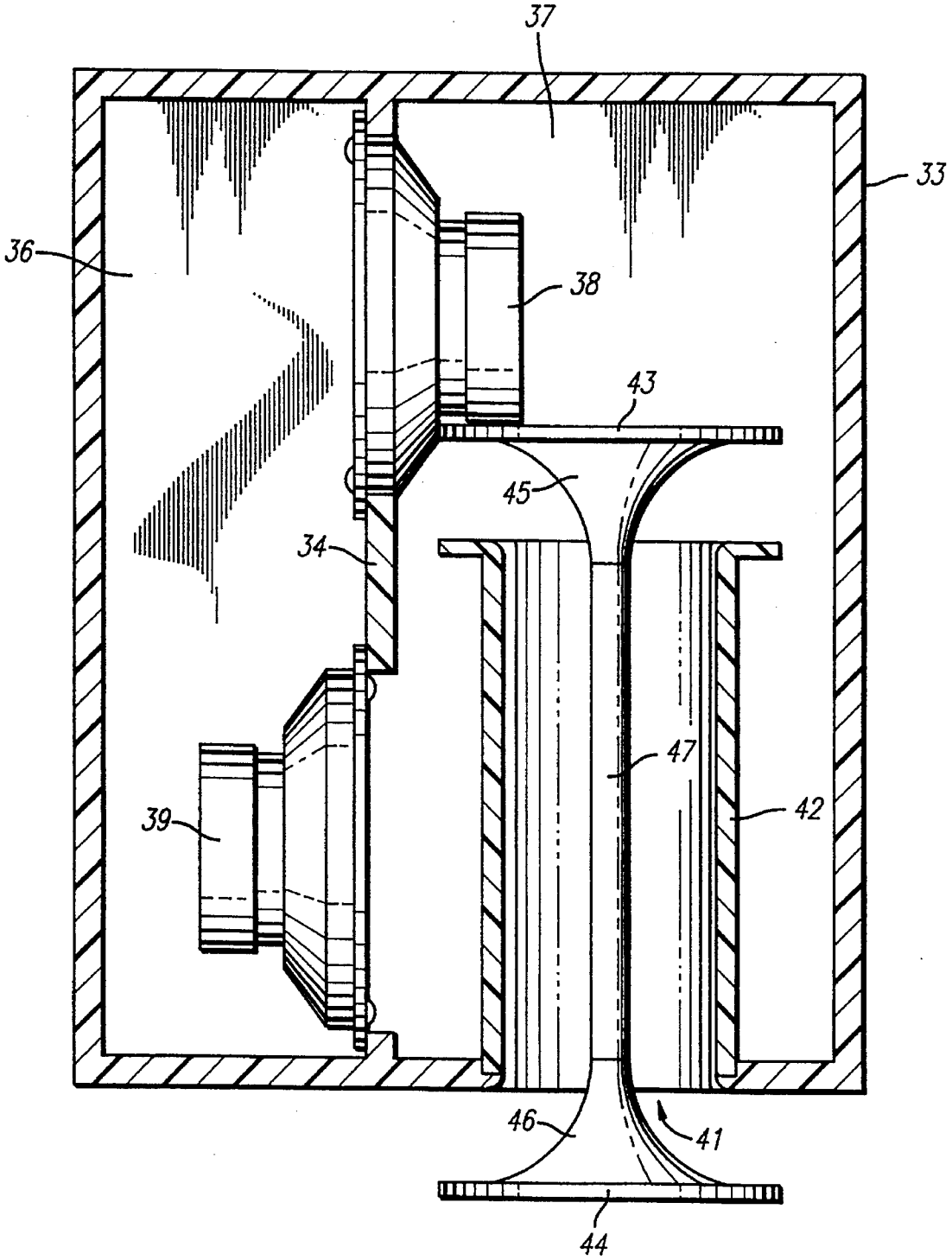
FIG. 7 is a cross-sectional view of one embodiment of a vented loudspeaker woofer having a novel port geometry in accordance with the principles of this invention.

Turning now to a consideration of FIG. 7, there is shown a preferred embodiment of the invention as incorporated into a complete woofer system of the band pass type. In FIG. 7 an enclosure 33 is provided with a partition 34 separating the interior of the enclosure into a sealed chamber 36 and a vented chamber 37. As shown in FIG. 7, two drivers 38 and 39 are mounted in the partition 34. A port opening 41 is provided to chamber 37 with a port or vent tube 42 extending from the opening 41 back into the interior of chamber 37. Disposed to either end of the port or vent tube are disks or baffle plates 43 and 44 having associated flow directors 45 and 46. Connecting the flow directors and extending through the vent tube is a connector 47. For clarity, struts which mount the disk and flow guide structure are not shown in FIG. 7.

In a co-pending application filed of even date herewith and entitled Band Pass Woofer and Method, there are disclosed band pass woofers and methods of designing same in which tuning ratios $Q_{tc}$, $Q_{mc}$ and $Q_{tp}$ are defined and constrained to be within certain empirically determined values. In accordance with the teachings of this co-pending patent application, band pass single vented woofers are obtained with a good relationship between flat response, bandwidth and efficiency. Unexpectedly, and in accordance with the teachings of that co-pending application, it has been found that by using higher moving mass and B1 product for the drivers that required dimensions of the enclosure can be significantly reduced. The disclosure of that co-pending application is hereby incorporated by reference, and it should be noted that FIG. 7 relates to an actual embodiment which uses the teachings of that co-pending patent application.

The actual parameters or variables of the band pass type woofer shown in FIG. 7 were as follows:

| Driver | |
|---|---|
| B1 = 14.72 weber · $m^{-1}$ | |
| Cms = .000263 m · $newton^{-1}$ | |
| Sd = .0648 $m^2$ | |
| Re = 4.04 ohm | |
| Mmd = .170 Kg | |
| fs = 23.168 Hz | |
| fc = 53.662 Hz | |
| **Port** | **Cabinet** |
| Sp2 = 48 $in^2$ | (Sealed) V1 = 1.2 $ft^3$ |
| t2 = 39.6 in | (Vented) V2 = 1.26 $ft^3$ |
| fp = 47.964 Hz | |

where the variables are defined as follows:

Bl=driver motor force factor
Cms=compliance of driver suspension
Sd=driver cone area
Re=driver voice coil DC resistance
Mmd=moving mass of the driver in kilograms
fs=free-air resonance of driver fc=the resonance of the driver in the sealed cavity Sp2=cross-sectional area of port t2=length of port fp=resonance of port mass against vented chamber V1=volume of sealed chamber V2=volume of vented chamber In accordance with the teachings of the co-pending patent application referred to above and filed on even date herewith, the three tuning ratios utilized in connection with the particular embodiment shown in FIG. 7 are as follows:

$Q_{tc}$=1.168

$Q_{mc}$=9.116

$Q_{tp}$ =1.019

In terms of dimensions in connection with the arrangement shown in FIG. 7, the dimensions of the enclosure 13 were 26 inches by 20.5 inches. The enclosure was 12 inches deep overall. The width of the sealed chamber 36 was 7 inches, and the diameter of the port and vent tube 42 was 5.688 inches. The disks or baffle plates, 43 and 44 were ½ inch thick with disk 43 having an 8.5 inch diameter and disk 44 having a 11.25 inch diameter. The flow guides 45 and 46 had a depth of 2.375 inches, with the curved surfaces formed on a 2.875 inch radius. The length of the port or vent tube 42 was 13.625 inches.

In the particular band pass type woofer shown in FIG. 7, the required acoustic mass of the port is somewhat large and the expected volume velocities are quite high. A computer model of the system suggested that a port 10 inches in diameter and 60 inches long would be required. The port specifications Sp2 and t2 given above were arbitrarily selected to give an equivalent acoustic mass to the port structure. However, in accordance with a preferred embodiment of the present invention and as shown in FIG. 7, a port structure was found to offer equivalent or better performance both in tuning the system and in providing the required volume velocities with very low turbulence. This port structure as shown in FIG. 7 is only 19 inches long overall and occupies approximately 750 cubic inches as compared to the equivalent 60 inch long port which occupies over 4700 cubic inches. The advantages of the present invention are clear.

Although the present invention has been discussed in connection with particular embodiments and examples thereof, it should be clear that the principles of this invention are applicable to variations from those examples and preferred embodiments, and it is intended by the appended claims to cover all embodiments which are fairly within the scope of the present invention.

We claim:

1. A loudspeaker system comprising a cabinet containing at least one distinct air volume, at least one active loudspeaker transducer mounted to said cabinet, at least one port or vent connecting the air volume inside the cabinet to air outside the cabinet for the purpose of radiating sound and wherein said port or vent comprises a duct having a varying cross-sectional area which varies according to a continuous or piece-wise continuous function from inside to outside the cabinet and which increases monotonically from a minimum value between the ends of said duct to a larger cross-section at at least one end thereof, the varying cross-sectional area of said duct being defined by an opening or port in a wall of the cabinet, a first disk or baffle plate having an area larger than the minimum value, means mounting said disk or plate substantially perpendicular to the port at a predetermined distance from said one end of the port to configure said duct at said one end as an opening extending substantially around the periphery of said disk or baffle plate, and including a flow guide substantially concentric to the port connected to said at least one disk or baffle plate and having curved or slanted sides extending from said disk or baffle plate back into said port, to thereby block areas of stagnant air and insure laminar airflow with reduced turbulence and noise.

2. The loudspeaker system of claim 1 wherein said port includes a second disk or baffle plate having an area larger than the minimum value, means mounting said second disk or plate substantially perpendicular to the port at a predetermined distance from a second end of said port opposite said first end, and including a second flow guide substantially concentric to the port connected to said second disk or baffle plate and extending back into the area of the port, said second flow guide having curved or slanted sides and serving to block areas of stagnant air and insure laminar flow throughout the port to minimize air turbulence and noise.

3. The loudspeaker system of claim 1 including a connector connected to said first flow guide and extending through the port at the central interior portion thereof, for channeling air through said port as a donut-shaped volume of moving air.

4. The loudspeaker system of claim 2 including a connector disposed along the central portion of the port and connecting said first flow guide to said second flow guide, for insuring a donut-shaped volume of air moving through the port.

5. A loudspeaker system in accordance with claim 1 wherein the predetermined distance between said first disk or baffle plate and said one end of the port is equal to approximately ½ the diameter of the port.

6. A loudspeaker system in accordance with claim 2 wherein the predetermined distance between said second disk or baffle plate and said second end of the port is equal to approximately ½ the diameter of the port.

7. A loudspeaker system in accordance with any of claims 1, 3 or 5 wherein said duct further extends from the port back into the interior of the cabinet.

8. A loudspeaker system in accordance with any of claims 2, 4 or 6 wherein said duct further extends from the port back into the interior of the cabinet, with said second disk or baffle plate suitably secured to the end of the ducting interior to the cabinet.

9. A loudspeaker system in accordance with claim 3 wherein said predetermined distance between said first disk or baffle plate and said one end of the port is approximately equal to the perpendicular distance from the connector to the inside of the port.

10. A loudspeaker system in accordance with claim 4 wherein said predetermined distance between said first disk or baffle plate and said first end of the port and said second disk or baffle plate and said second end of the port are each equal to approximately ½ the diameter of the port.

11. A method of venting a loudspeaker system of the type comprising a cabinet containing at least one distinct air volume, at least one active loudspeaker transducer mounted to said cabinet and at least one passive radiating port connecting the air volume inside the cabinet to air outside the cabinet for the purpose of radiating sound, the method comprising the steps of forming the at least one passive radiating port with a duct having a varying cross sectional area which varies according to a continuous or piece-wise continuous function from inside to outside the cabinet and which increases monotonically from a minimum value between the ends of the duct to a larger cross section at at least one end thereof, the varying cross sectional area of the duct being defined by forming an opening or port in a wall of the cabinet, mounting a first disk or baffle plate having an area larger than the minimum value substantially perpendicular to the port and a predetermined distance from the one end of the port to configure the duct at the one end as an opening extending substantially around the perimeter of the disk or baffle plate, and providing a flow guide substantially concentric to the port having curved or slanted sides extending from the first disk or baffle plate back into the duct.

* * * * *